US006089346A

United States Patent [19]

Tredinnick et al.

[11] Patent Number: 6,089,346

[45] Date of Patent: Jul. 18, 2000

[54] MUFFLER WITH ACOUSTIC BARRIER MATERIAL FOR LIMITED CLEARANCE PNEUMATIC DEVICE APPLICATIONS

[75] Inventors: Kenneth F. Tredinnick, Vadnais Heights; George D. G. Hilling, Roseville; Russell E. Blette, Hastings, all of Minn.

[73] Assignee: 3M Innovative Properties Company, St. Paul, Minn.

[21] Appl. No.: 09/324,208

[22] Filed: Jun. 2, 1999

[51] Int. Cl.[7] ..... F01N 3/02

[52] U.S. Cl. ..... 181/230; 181/258

[58] Field of Search ..... 181/229, 230, 181/243, 252, 256, 258, 282; 173/DIG. 2

[56] References Cited

U.S. PATENT DOCUMENTS

| | | | |
|---|---|---|---|
| 2,017,744 | 10/1935 | Bourne . | |
| 3,547,223 | 12/1970 | Gibel | 181/230 |
| 3,757,892 | 9/1973 | Raudman, Jr. . | |
| 3,811,845 | 5/1974 | Nakamura . | |
| 3,863,733 | 2/1975 | Raudman, Jr. et al. . | |
| 3,884,037 | 5/1975 | Barber et al. . | |
| 4,032,310 | 6/1977 | Ignoffo . | |
| 4,228,868 | 10/1980 | Raczuk . | |
| 4,368,799 | 1/1983 | Wagner . | |
| 4,487,290 | 12/1984 | Flaherty . | |
| 4,580,657 | 4/1986 | Schmeichel et al. . | |
| 4,598,790 | 7/1986 | Uesugi et al. . | |
| 5,198,625 | 3/1993 | Borla . | |
| 5,246,473 | 9/1993 | Harris . | |
| 5,350,888 | 9/1994 | Sager, Jr. et al. . | |
| 5,504,281 | 4/1996 | Whitney et al. . | |
| 5,602,368 | 2/1997 | Kaneso . | |
| 5,658,656 | 8/1997 | Whitney et al. . | |
| 5,661,272 | 8/1997 | Iannetti . | |
| 5,777,947 | 7/1998 | Ahuja . | |
| 5,783,782 | 7/1998 | Sterrett et al. . | |
| 5,952,623 | 9/1999 | Sterling | 181/230 |

OTHER PUBLICATIONS

Catalog 105, McMaster–Carr Supply Company, pp. 220–221, Chicago, Illinois, © 1999.

Brochure entitled "Pneumatic Mufflers for many pumps, motors, other air–operated equipment", by 3M, ©1997.

Brochure entitled "Pneumatic Muffler for many pumps, other air–operated equipment", by 3M, © 1998.

*Primary Examiner*—Khanh Dang

*Attorney, Agent, or Firm*—Lisa M. McGeehan

[57] ABSTRACT

A muffler for attenuating noise produced by a pneumatic device having limited clearance. The muffler includes a housing and an acoustic barrier material. The housing includes an inlet and an outlet. In one preferred embodiment, at least a portion of the housing is frusto-conical such that the outlet has a width greater than a diameter of the inlet. Further, the housing preferably has a maximum width less than approximately 1.5 inches (38 mm). The acoustic barrier material is disposed within the housing and is forms a plurality of microbubbles. Further, the acoustic barrier material is configured to conform to a shape of the housing. The muffler can be utilized with a pneumatic valve having limited space available for receiving the muffler, providing significant noise reduction with minimal back pressure.

38 Claims, 5 Drawing Sheets

MUFFLER WITH ACOUSTIC BARRIER MATERIAL FOR LIMITED CLEARANCE PNEUMATIC DEVICE APPLICATIONS

BACKGROUND OF THE INVENTION

The present invention concerns a muffler for attenuating noise produced by a pneumatic device. More particularly, it relates to a reduced-size muffler for use with a pneumatic device having limited available area for muffler placement.

A wide variety of different devices are pneumatically controlled and/or actuated. Such devices include processing equipment incorporating one or more pneumatic valve banks, pneumatic robotic applications, pneumatic testing equipment, hand held tools, pumps, etc. Basically, flow of a pressurized fluid, normally air, is used to actuate or maneuver a mechanism, such as a linkage arm, resulting in a desired output. Depending upon the particular application, one or more pneumatic valves are typically incorporated to direct the forced air to a desired location within the device, as well as to release the air through an exhaust port. Because the air is pressurized and the exhaust port relatively small, the exhausted air is normally traveling at a high velocity. As the high velocity air flows into relatively still air, the airflow becomes turbulent. Eddies associated with the now turbulent airflow generate pressure fluctuations, resulting in exhaust noise.

Depending upon the particular application, the exhaust noise may rise to an unacceptable level, possibly causing noise-induced hearing loss. As a point of reference, United States standards require hearing protection for individuals exposed to continuous noise levels in excess of 85 decibels (dB) over an eight-hour period. International standards require hearing protection for noise levels in excess of 80 dB over an eight-hour period. Notably, exhaust noise at less than 80 dB, or intermittent noise at levels greater than 80 dB, can be equally irritating and harmful.

Various techniques can be employed to minimize the effect of exhaust noise produced by a pneumatic device. For example, an individual working in close proximity to the device may be provided with hearing protection. Unfortunately, the operator may forget to wear the hearing protection, or may simply choose not to use it due to perceived inconveniences. Additionally, other nearby workers or visitors who do not wear hearing protection will be subjected to the same noise-related concerns. Alternatively, a sound barrier or enclosure may be placed around the device. In many instances, however, this approach is not viable from both a cost standpoint and because an external barrier might impede proper device operation. A third, more practical approach is to connect a muffler or silencer to the exhaust port.

Generally speaking, pneumatic device-related mufflers attenuate noise by presenting a barrier to airflow, absorbing sound waves, or both. For most commercial applications, a typical muffler includes a cylindrical housing designed for mounting to the exhaust port. The housing defines one or more internal chambers through which air from the exhaust port is directed. Further, an airflow barrier and/or sound absorption insert is normally disposed within the housing. Finally, the housing will form one or more airflow passages or apertures through which air is released (or exhausted) from the muffler. A wide variety of materials are available for use as the insert, ranging from metals and cloth to ceramic composite materials. For example, various pneumatic muffler products are available from Minnesota Mining & Manufacturing Company of St. Paul, Minn. that make use of a replaceable acoustic barrier insert.

Regardless of the exact configuration, two important parameters must be considered when assessing pneumatic muffler performance. First, the muffler must limit exhaust noise to an acceptable level. Additionally, any back pressure caused by the muffler must be considered. In simplest terms, a portion of the total system pressure is required to push a given airflow through the muffler. This pressure is referred to as the "back pressure" of the muffler. Depending upon the particular application and level of back pressure, overall performance of the pneumatic device may be greatly diminished.

It is well known that noise attenuation and back pressure minimization are inversely related. That is to say, the noise reduction characteristic of a particular pneumatic muffler may be enhanced by incorporating additional or a more dense insert material. However, this additional material or material density will likely increase back pressure, thereby diminishing muffler usefulness. With this relationship in mind, noise attenuation and back pressure can be optimized by designing the muffler housing and associated insert material to be relatively large. For example, most commercially available pneumatic mufflers have a length in the range of 4–8 inches (102–203 mm) and an outer diameter in the range of 1.5–4 inches (38–102 mm).

Pneumatic mufflers adhering to the above-described dimensional characteristics have proven to be highly effective in attenuating pneumatic exhaust noise with minimal back pressure. Unfortunately, however, certain pneumatic device applications do not provide sufficient muffler clearance. For example, certain types of processing equipment (e.g., a mail sorter) include a valve bank incorporating a large number of pneumatic valves (and thus exhaust ports) positioned in close proximity to one another. Often times, the valve exhaust ports have a center-to-center spacing of less than 1.5 inches (38 mm). Obviously, the above-described "standard" muffler sizes prohibit their use with these limited clearance applications as it is impossible to mount two of the mufflers side-by-side. Further, where the muffler housing is relatively long and extends an appreciable distance from the pneumatic device, the opportunity for an operator to inadvertently contact and possibly break or otherwise damage the muffler becomes increasingly prevalent.

Efforts have been made to overcome the clearance problems associated with closely spaced pneumatic valve exhaust ports. For example, tubing can be connected to each of the exhaust ports and then routed to a single muffler at a location spaced from the exhaust ports. This technique is expensive and time consuming, and likely results in prohibitive back pressure. Alternatively, attempts have been made to produce a reduced-sized cylindrical muffler housing containing a barrier material such as sintered brass or felt. While a series of these so-configured mufflers can be mounted side-by-side to a confined clearance valve bank, the necessarily small volume of selected insert material associated with each of the individual mufflers cannot alter airflow and/or absorb noise to provide sufficient noise reduction.

Mufflers for use in attenuating noise produced by pneumatic devices continue to be extremely popular. However, where the particular pneumatic device has very limited clearance space for receiving the muffler, "standard" sized mufflers cannot be used. Efforts to design a viable, reduced-sized pneumatic muffler have been unavailing. Therefore, a need exists for a pneumatic muffler having acceptable noise reduction and back pressure characteristics that is sized for use with restricted clearance space applications.

SUMMARY OF THE INVENTION

One aspect of the present invention relates to a muffler for attenuating noise produced at an exhaust port of a pneumatic device. The muffler comprises a housing and an acoustic barrier material. The housing defines an inlet and an outlet. The inlet is configured for mounting to the exhaust port. Further, at least a portion of the housing is frusto-conical such that the outlet has a diameter greater than a diameter of the inlet. The acoustic barrier material includes a plurality of microbubbles and is disposed within the housing. To this end, the acoustic barrier material is configured to conform to a shape of the housing.

Prior to use, the housing is mounted to the exhaust port at the inlet. Pressurized air from the exhaust port is directed, via the inlet, into contact with the acoustic barrier material. The acoustic barrier material presents a large number of tortuous pathways thereby altering or diffusing the airflow and transferring acoustic energy to heat energy. Additionally, due to the frusto-conical shape, the housing serves to more evenly distribute the air through the acoustic barrier material, as well as to minimize formation of turbulent flow. With these properties in mind, the muffler effectuates distinct noise attenuation. Notably, the acoustic barrier material in combination with the frusto-conically shaped housing generates minimal back pressure.

Another aspect of the present invention relates to a muffler for attenuating noise produced at an exhaust port of a pneumatic device. The muffler comprises a housing and an acoustic barrier material. The housing includes an inlet and an outlet, with the inlet being configured for mounting to the exhaust port. Further, the housing has a maximum width of less than approximately 1.5 inches (38 mm). For example, in one preferred embodiment, the housing is frusto-conical and thus has a maximum cross-sectional diameter (or width) less than approximately 1.5 inches (38 mm). The acoustic barrier material includes a plurality of microbubbles and is disposed within the housing. More particularly, the acoustic barrier material is configured to conform to a shape of the housing. In one preferred embodiment, the housing defines an extension length of less than approximately 1.5 inches (38 mm).

Prior to use, the muffler is mounted to the exhaust port at the inlet. The limited maximum width of the housing facilitates the muffler being mounted in a confined area. Further, a series of similarly configured mufflers can be placed side-by-side as part of a pneumatic valve bank having closely spaced exhaust ports. Air entering the muffler is directed into contact with the acoustic barrier material. The acoustic barrier material provides a barrier to airflow. Due to a resulting alteration in airflow, the muffler limits noise that would otherwise be generated at the exhaust port with minimal back pressure.

Yet another aspect of the present invention relates to a method of manufacturing a muffler for attenuating noise produced at an exhaust port of a pneumatic device. The method includes providing a housing that has an inlet and an outlet. An acoustic barrier material including a plurality of microbubbles is similarly provided. The acoustic barrier material is selected to be flowable in a first state and relatively rigid in a second state. The acoustic barrier material is inserted into the housing in the first state such that the acoustic barrier material conforms with a shape of the housing. Finally, the acoustic barrier material within the housing is transitioned to the second state, such that the material is relatively rigid. In this relatively rigid state, the acoustic barrier material serves as a barrier to airflow entering the muffler at the inlet.

DETAILED DESCRIPTION OF THE PREFERRED EMBODIMENTS

Figure 1:
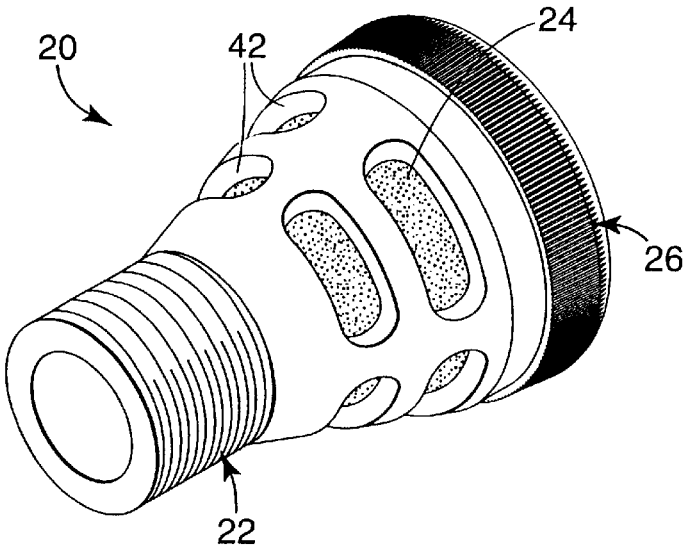
FIG. 1 is a perspective view of a muffler in accordance with the present invention.

One preferred embodiment of a muffler 20 is shown in FIG. 1. The muffler 20 includes a housing 22, an acoustic barrier material 24 and a cover 26 (shown partially in FIG. 1). In general terms, the acoustic barrier material 24 is disposed within the housing 22. The cover 26 is mounted over an end of the housing 22.

Figure 2:
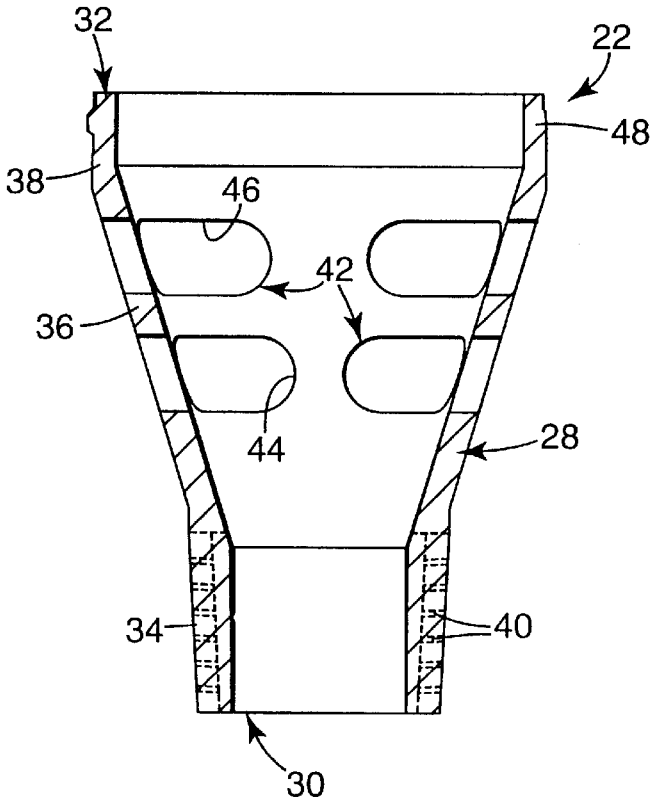
FIG. 2 is an enlarged, side, cross-sectional view of a housing portion of the muffler of FIG. 1.

With reference to FIGS. 1 and 2, the housing 22 includes a side wall 28 forming an inlet 30 and an outlet 32, and is defined by an inlet section 34, a central section 36 and an outlet section 38. As a point of reference, upon final assembly, air enters the muffler 20 at the inlet 30 and is directed generally toward the outlet 32. Thus, various components and/or locations can be described as being "upstream" of the inlet 30 or "downstream" of the outlet 32, it being understood that use of directional terminology is for purposes of illustration only and is in no way limiting.

The inlet section 34 is preferably cylindrical and is configured for mounting to a pneumatic device exhaust port (not shown). Thus, in one preferred embodiment, the inlet section 34 forms exterior threads 40. Alternatively, other mounting techniques and related designs may be used. With the preferred exterior threads 40, however, the inlet section 34 is sized in accordance with a "standard" exhaust port size. Thus, for example, the inlet section 34 preferably has an outer diameter corresponding with a ⅛ inch National Pipe Taper (NPT) exhaust port. Alternatively, the inlet section 34 may be sized to correspond with a ¼ inch NPT, ⅜ inch NPT, ½ inch NPT, ¾ inch NPT or 1 inch NPT. Even further, where the exhaust port implements a mounting design other than National Pipe Taper (e.g., non-tapered), the inlet section 34 will assume a corresponding configuration.

The central section 36 extends from the inlet section 34 and is preferably frusto-conical in shape. More particularly, the central section 36 extends in an angular fashion from the inlet section 34 to the outlet section 38 such that the outlet 32 has a diameter greater than a diameter of the inlet 30. With respect to the longitudinal cross-section view of FIG. 2, the frusto-conical shape of the side wall 28 at the central section 36 preferably forms an included angle in the range of approximately 100°–170°, more about preferably 125°–160°, although other dimensional characteristics may also be useful. For example, the central section 36 may be cylindrical. Even further, the central section 36 need not be circular in transverse cross-section. For example, the central section 36 may assume a triangular, square, octagonal, etc. transverse cross-sectional shape.

In a preferred embodiment, the central section 36 preferably forms a plurality of airflow apertures, shown generally at 42. Each of the plurality of apertures 42 extend through the side wall 28 to allow airflow from an interior of the housing 22. In one preferred embodiment, the plurality of apertures 42 includes a first row of slots 44 and a second row of slots 46, with each of the slots 44, 46 extending in a circumferential fashion. As shown in FIG. 2, the first row of slots 44 are formed adjacent the inlet section 34, whereas the second row of slots 46 are formed adjacent the outlet section 38. Each of the slots 44, 46 are preferably sized and spaced so as to provide maximum airflow capacity without overly diminishing a structural integrity of the housing 22. Thus, for example, each of the slots 44, 46 has a height (relative to the orientation of FIG. 2) in the range of approximately 0.1–0.2 inch (2.5–5 mm), and are spaced by approximately 0.1 inch (2.5 mm). Alternatively, other sizes, spacing and orientations may also be acceptable. For example, each of the slots 44, 46 may extend axially as opposed to circumferentially. Further, the plurality of apertures 42 need not assume a slot configuration, but instead can be any shape, such as circular, square, etc.

The outlet section 38 extends from the central section 36 and is preferably cylindrical. In a preferred embodiment, the outlet section 38 forms an annular rib 48. The annular rib 48 is sized to selectively maintain the cover 26 (FIG. 1), as described in greater detail below.

The various sections of the housing 22 are preferably integrally formed from a relatively rigid material. For example, in one preferred embodiment, the housing 22 is a molded polymer, preferably polyamide (nylon 6, 6 (PA 66) 33% by weight glass reinforced). Alternatively, other polymers such as polypropylene may be useful. Essentially, the housing 22 can be any moldable or machinable material such as, for example, a ceramic, steel or aluminum, and combinations or compositions thereof.

Taken as a whole, the housing 22 is preferably sized for use with a pneumatic device having a limited muffler footprint or clearance. More particularly, the housing 22 preferably has a maximum width (defined in transverse cross-section) that is less than 1.5 inches (38 mm); more preferably less than about 1 inch (25 mm). Thus, in the one preferred embodiment where the housing 22 is circular in transverse cross-section, the housing 22 preferably has a maximum diameter (or width), defined by an outer diameter of the side wall 28 at the outlet 32, less than about 1.5 inches (38 mm); more preferably less than 1 inch (25 mm). For example, in one preferred embodiment, the outlet 32 has an outer diameter of about 0.94 inch (23.9 mm). The interior width (preferably an inner diameter) of the side wall 28 at the outlet 32 is dependent upon a thickness of the side wall 28. In a preferred embodiment, the side wall 28 has a thickness in the range of approximately 0.01–0.1 inch (0.25–2.5 mm), thereby maximizing the inner width or diameter of the outlet 32. Finally, the housing 22 preferably has a limited height or length (defined as a distance from the inlet 30 to the outlet 32). More particularly, a length (or height relative to the orientation of FIG. 2) of the housing 22 is preferably less than approximately 1.5 inches (38 mm); more preferably less than approximately 1.25 inches (32 mm). It should be noted that during use, the inlet section 34 is typically mounted within an exhaust port (not shown), such that only the central section 36 and the outlet section 38 extend outwardly. With this in mind, a final assembly extension length of the housing 22 (defined by a combination of the central section 36 and the outlet section 38) is preferably less than approximately 1.5 inches (38 mm); more preferably less than approximately 1.25 inches (32 mm); most preferably less than approximately 1 inch (25 mm). For example, in one preferred embodiment, the housing 22 has an overall length or height of 1.16 inches (29.5 mm), and a final assembly extension length of 0.91 inch (23.1 mm).

Figure 3:
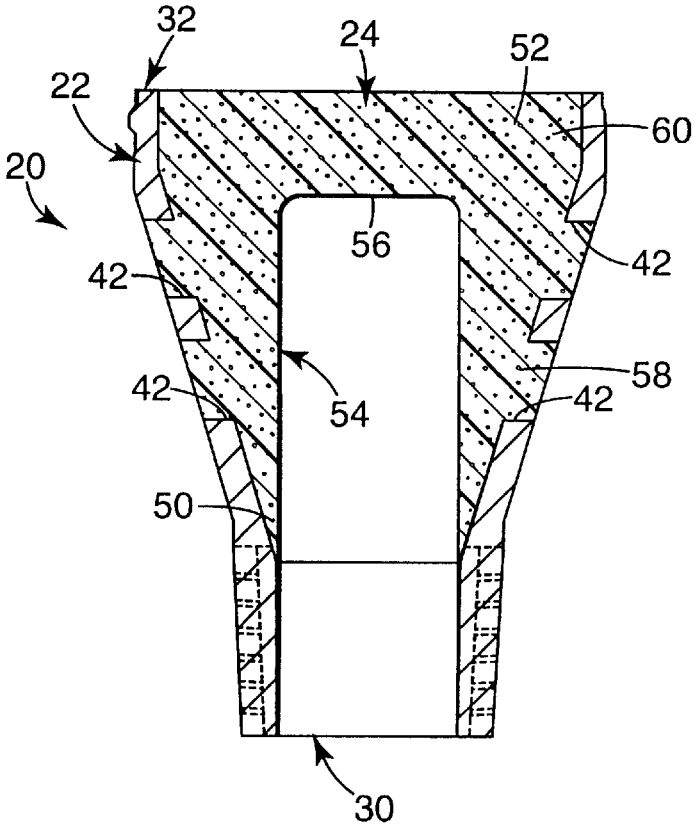
FIG. 3 is an enlarged, side, cross-sectional view of the muffler of FIG. 1, shown without a cover.

As shown in FIG. 3, the acoustic barrier material 24 is disposed within the housing 22. The acoustic barrier material 24 is preferably configured to conform with a shape of the housing 22, defining a leading end 50 adjacent the inlet 30 and a trailing end 52 adjacent the outlet 32. The leading end 50 is preferably positioned downstream of the inlet 30; whereas the trailing end 52 is preferably approximately contiguous with the outlet 32. Finally, following the manufacturing process described below, portions of the acoustic barrier material 24 preferably extend through at least one of, preferably each of, the apertures 42 so as to secure the acoustic barrier material 24 to the housing 22.

In a preferred embodiment, the acoustic barrier material 24 forms a core passage 54. As depicted in FIG. 3, the core passage 54 is open at the leading end 50, and thus in fluid communication with the inlet 30 of the housing 22. The core passage 54 extends downstream in a generally axial fashion (relative to a central axis defined by the housing 22) from the leading end 50 toward the trailing end 52. Preferably, the core passage 54 does not pass through the trailing end 52. In other words, the core passage 54 terminates at a closed end 56 positioned upstream of the trailing end 52 such that the core passage 54 is closed relative to the trailing end 52. In a preferred embodiment, the core passage 54 extends beyond the apertures 42. In other words, the closed end 56 is preferably positioned downstream of the apertures 42. Finally, the core passage 54 preferably has a uniform diameter, approximating an inner diameter of the inlet 30. Alternatively, the core passage 54 may be non-uniform and may have a diameter varying from that of the inlet 30.

By incorporating the core passage 54, the acoustic barrier material 24 is effectively definable by an upstream portion 58 and a downstream portion 60 (shown generally in FIG. 3). The upstream portion 58 extends from the leading end 50 and encompasses the core passage 54. The downstream portion 60, conversely, defines the closed end 56 of the core passage 54 and extends to the trailing end 52. The downstream portion 60 is generally disk-shaped, and is continuous across a diameter of the housing 22. With this configuration, the downstream portion 60 provides a relatively complete, radial barrier to airflow directed through the axially-orientated core passage 54. In a preferred embodiment, the downstream portion 60 has an axial thickness (or height) in the range of approximately 0.1–0.3 inch (2.5–7.6 mm); most preferably 0.2 inch (5 mm). Thus, where the trailing end 52 is contiguous with the outlet 32 of the housing 22, the core passage 54 is formed such that the closed end 56 is approximately 0.1–0.3 inch (2.5–7.6 mm) from the outlet 32; most preferably 0.2 inch (5 mm).

The acoustic barrier material 24 preferably includes a plurality of microbubbles and is configured to serve as an acoustic (or airflow) barrier. In one preferred embodiment, the acoustic barrier material comprises ceramic microbubbles, each having an average outer diameter of about 5–150 microns, bound together at their contact points. As used in this specification, the term "ceramic" is understood to include glass. The acoustic barrier material is preferably characterized by either a porosity of about 20–60 percent, or by voids between the microbubbles which have a characteristic diameter within an order magnitude of the viscous skin depth of the air flowing through the muffler 20, as calculated at 1 kHz; an airflow resistivity of about $0.5\times10^4$–$4\times10^7$ mks rayls/meter, and an attenuation of sound comparable to mass law performance. The microbubbles can be sintered into direct contact with each other, or one of many types of binder material can be used to support the microbubbles within a composite material. For example, the binder may be made from an inorganic or organic material including ceramic, polymeric, and elastomeric materials. Acceptable materials for use as the acoustic barrier material are described, for example, in U.S. Pat. Nos. 5,658,656 and 5,504,281, the teachings of which are incorporated herein by reference.

Regardless of exact composition, the acoustic barrier material 24 establishes a vast number of minute tortuous passageways (not shown). Air directed into contact with the acoustic barrier material 24 is thereby forced through these passageways, causing an alteration in airflow velocity.

Figure 4:
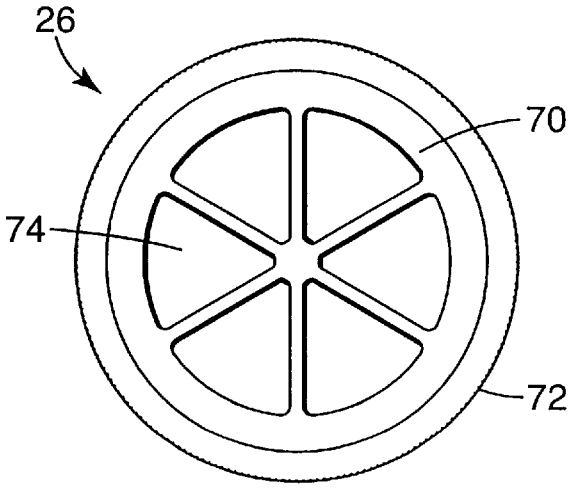
FIG. 4 is a perspective view of a cover portion of the muffler of FIG. 1.

The cover 26 is shown in greater detail in FIG. 4. The cover 26 includes a base 70 and a flange 72 (shown partially in FIG. 4). The base 70 conforms with a shape of the outlet 32 of the housing 22, and thus is preferably circular, and forms a plurality of openings 74. The openings 74 are sized to facilitate airflow through the cover 26 upon final assembly. Alternatively, a single opening may be provided.

Figure 7:
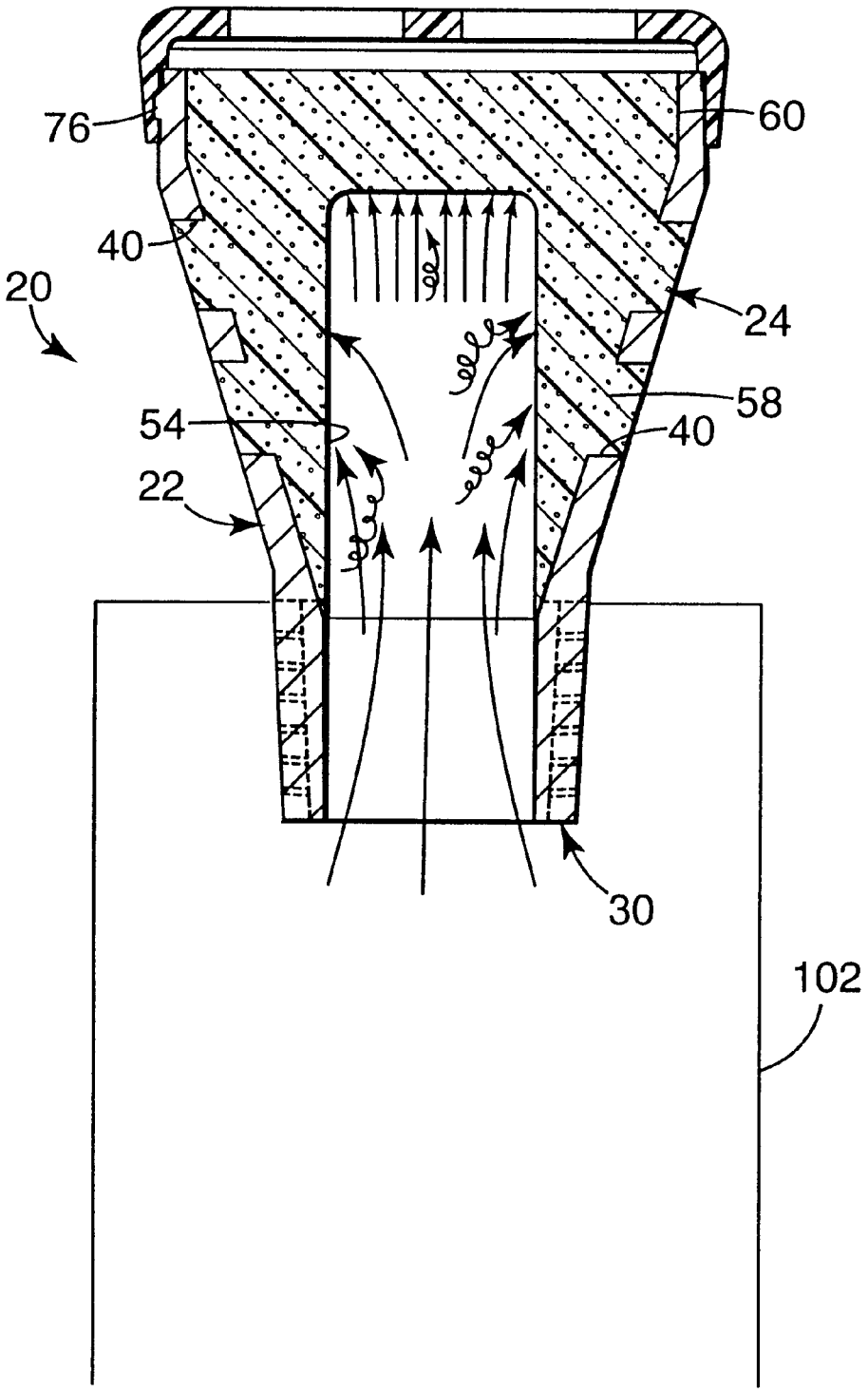
FIG. 7 is an enlarged, side, cross-sectional view of a portion of the device of FIG. 6 depicting airflow through a muffler.

The flange 72 extends in an annular fashion from the base 70 and is sized for mounting to the outlet section 38 (FIG. 2). In this regard, the flange 72 preferably forms an annular recess 76 (shown best in FIG. 7). The annular recess 76 is sized to receive the annular rib 48 (FIG. 2) of the housing 22. With this configuration, the cover 26 is mounted to the housing 22 via a snap fit. Alternatively, the cover 26 may be configured for mounting to the housing 22 with other attachment techniques, such as an interference fit, an adhesive, threaded fit, etc. The cover 26 is preferably relatively thin so as to minimize an overall size of the muffler 20 (FIG. 1). For example, with the preferred embodiment, the flange 72 has a radial thickness in the range of approximately 0.01–0.05 inch (0.25–1.2 mm). Further, an outer surface of the flange 72 may be knurled to facilitate manual mounting of the muffler 20.

In one preferred embodiment, the cover 26 is comprised of the same material as the housing 22. Thus, for example, the cover 26 is a molded polymer such as polyamide or polypropylene. Alternatively, other relatively rigid materials may be used.

Figure 5:
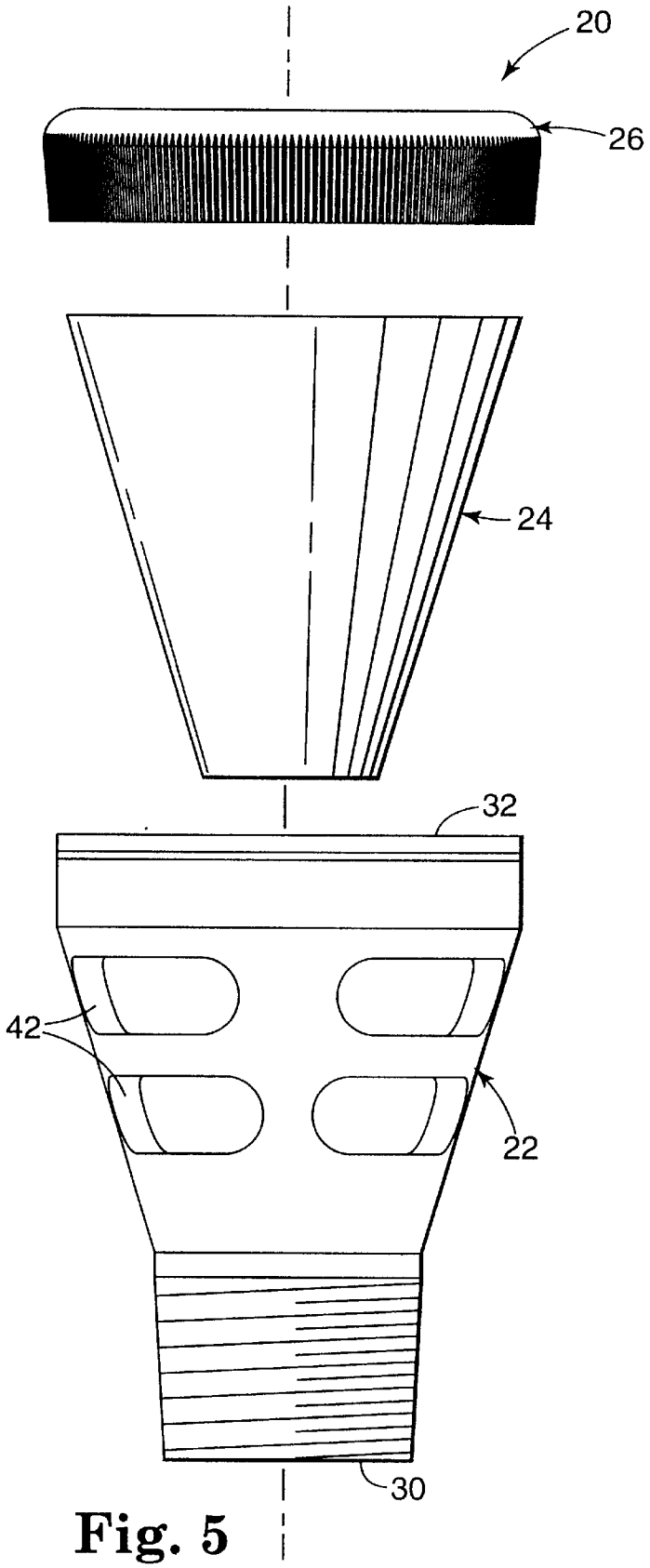
FIG. 5 is an exploded, side view of the muffler of FIG. 1.

FIG. 5 depicts assembly of the muffler 20. Following formation of the housing 22, the acoustic barrier material 24 is inserted therein. To this end, in one preferred embodiment, the material selected for the acoustic barrier material 24 is flowable in a first state. For example, the acoustic barrier material 24 may be in a powder form, or may be liquid-like in the first state. With this configuration, the acoustic barrier material 24 is effectively poured into the housing 22 in this first state. For example, where the acoustical composite material 24 is a powder in the first state, an air injection-type device can be employed to blow the powder into the housing 22. To prevent release of excessive amounts of the acoustic barrier material 24 through the apertures 42 during this insertion step, the housing 22 is preferably placed within a mold sized to conform with an outside of the housing 22. The mold is a negative of the housing 22 and serves to impede leaking of the acoustic barrier material 24 (in the flowable state) beyond the apertures 42. In a preferred embodiment, the mold is comprised of a non-stick material, for example a fluoropolymer such as Teflon™ available from DuPont. Similarly, the inlet 30 of the housing 22 is closed prior to insertion of the acoustic barrier material 24. Further, to form the preferred core passage 54 (FIG. 3), a post (which may be a part of the mold) is placed into the housing 22, extending from the inlet 30 to a desired level. During the subsequent insertion process, then, the acoustic barrier material 24 forms about the post, resulting in the core passage 54.

The acoustic barrier material 24 is preferably packed within the housing 22 and transitioned to a second, relatively rigid state. For example, the acoustic barrier material 24 is allowed to cure or otherwise solidify. This step may be enhanced by heating the material 24. In this second state, the acoustic barrier material 24 assumes a relatively rigid, non-flowable (preferably solid), substantially integral form. The housing 22 is then displaced from the mold and any excess acoustic barrier material removed from an exterior of the housing 22, such as by buffing or sanding. As shown best in FIG. 3, in the final, rigid state, the acoustic barrier material 24 is substantially contiguous with the outlet 32 of the housing 22. Further, due to the now relatively rigid, integral form, the portions of the acoustic barrier material 24 extending through the apertures 42 secure the acoustic barrier material 24 within the housing 22.

Alternatively, the acoustic barrier material 24 may be formed apart from the housing 22. That is to say, a block of acoustic barrier material (in a relatively rigid state) may be processed (e.g., cut) to a size and shape corresponding to an internal volume of the housing 22. The core passage 54 may then be formed by a boring operation. Once properly formed, the acoustic barrier material 24 is then simply inserted within the housing 22. The cover 26 is mounted to the housing 22 at the outlet 32. In one preferred embodiment, the cover 26 is secured to the housing 22 by a snap fit, although other mounting techniques may also be useful. Notably, because the acoustic barrier material 24 is solid and independently secured within the housing 22 via the apertures 42, the cover 26 is preferably not required to maintain the acoustic barrier material 24. Thus, the cover 26 is not a necessary element. However, for aesthetic purposes, the cover 26 may be provided. Alternatively, where the acoustic barrier material 24 is not independently mounted, the cover 26 may be necessary to prevent displacement of the acoustic barrier material 24 from the housing 22.

Figure 6:
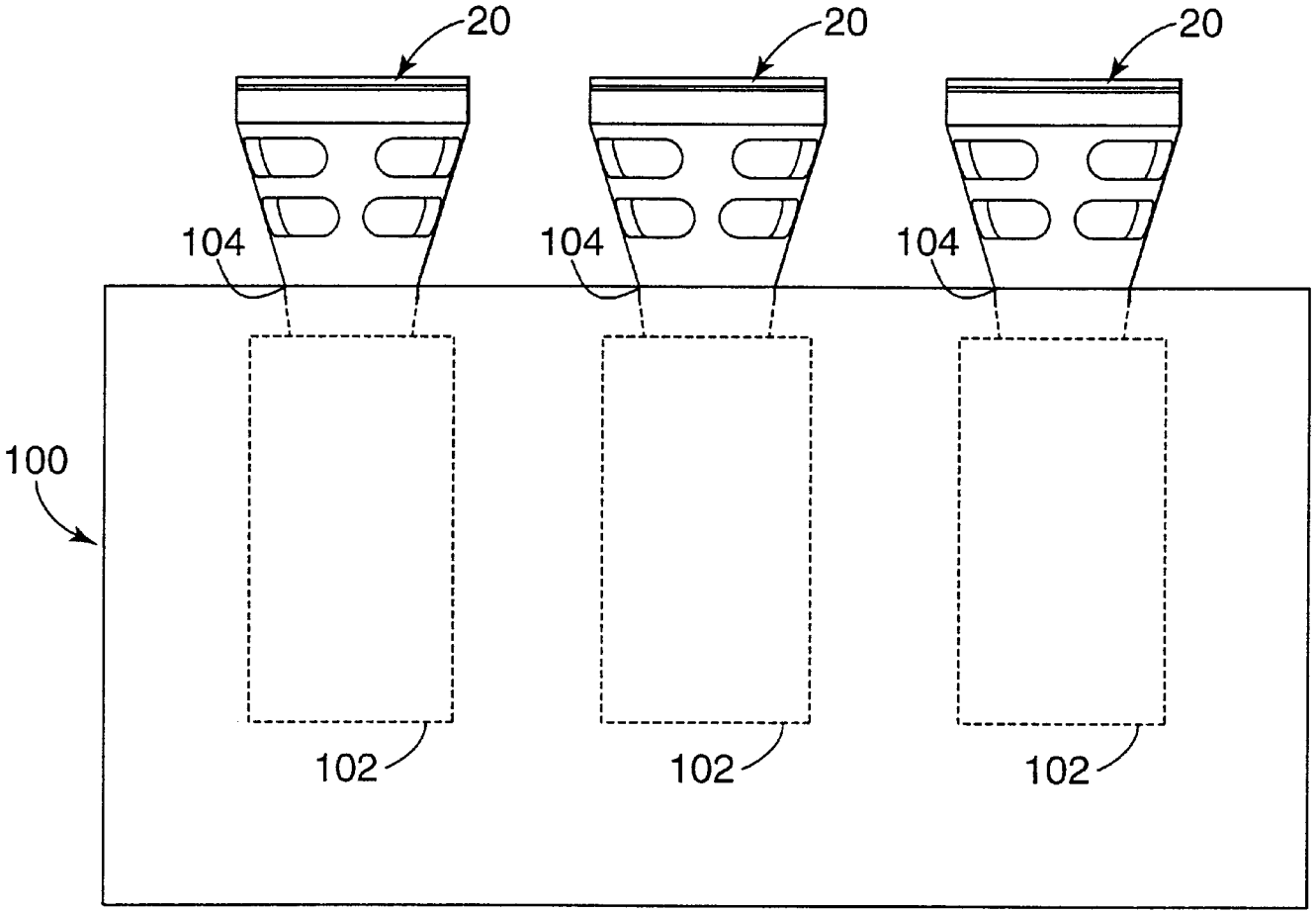
FIG. 6 is a side, elevational view of a pneumatic device incorporating mufflers in accordance with the present invention.

Upon final assembly, the muffler 20 is used to attenuate noise produced by a pneumatic valve. For example, FIG. 6 depicts a pneumatic valve bank 100. The valve bank 100 may be formed as part of an auxiliary device (not shown), such as a manufacturing and/or processing device or pneumatic robotic application. Alternatively, the muffler 20 may be used with a single valve associated with a pump or other pneumatic device. With respect to the application shown in FIG. 6, the valve bank 100 is shown as including three pneumatic valves 102 (shown generally in FIG. 6), each forming an exhaust port 104. In general terms, operation of each of the pneumatic valves 102 generates pressurized air exiting through the respective exhaust port 104. If left open, the forced air exiting the exhaust ports 104 would become highly turbulent, resulting in noise. This noise is attenuated by associating a muffler 20 in accordance with the present invention with each of the exhaust ports 104, respectively.

Prior to use, each of the mufflers 20 are mounted to a respective one of the exhaust ports 104. For example, with standard pneumatic valve applications, each of the exhaust ports 104 are threaded. With reference to FIG. 2, the housing 22 associated with each of the mufflers 20 is similarly threaded for a threaded mounting to the exhaust ports 104, respectively. Alternatively, a variety of other mounting techniques may be incorporated. Importantly, the pneumatic valves 102 associated with the valve bank 100 are depicted as being closely spaced to one another. This arrangement arises quite frequently with commercial applications, whereby the pneumatic valves 102, and thus the exhaust ports 104, have a side-to-side spacing of less than 1.5 inches (38 mm). Under these confined clearance conditions, it is impossible to use "standard" mufflers due to their oversized housings. The muffler 20 of the present invention, however, can be used with limited clearance pneumatic valves 102, as the muffler 20 has a maximum width of less than approximately 1.5 inches (38 mm). Further, because the muffler 20 extends from the valve bank 100 by less than approximately 1.5 inches (38 mm), the opportunity for inadvertent contact and damage is greatly reduced.

Once secured to the valve bank 100, the mufflers 20 attenuate noise produced at the exhaust ports 104. An individual one of the mufflers 20 with one of the pneumatic valves 102 is shown in greater detail in FIG. 7. Air enters the muffler 20 at the inlet 30 and is directed downstream toward the acoustic barrier material 24 (shown with arrows). A majority of the turbulent airflow is directed axially via the core passage 54 toward the downstream portion 60 of the acoustic barrier material 24. As previously described, the downstream portion 60 presents a barrier to the airflow. Further, a cross-sectional area of the acoustic barrier material 24 is greater than that of the exhaust port 104. Effectively, the acoustic barrier material 24 transfers acoustic energy to heat energy by interaction of the airflow with the acoustic barrier material 24. On a microscopic level, the acoustic barrier material 24 presents an extremely large number of small, tortuous passageways to the airflow. Airflow is distributed or diffused through these passageways at a reduced velocity, creating a more laminar flow. It is well known that laminar airflow does not create the pressure-producing eddies associated with turbulent airflow, and therefore produces little or no noise. Notably, it has been found that with the preferred composition of the acoustic barrier material 24 described above, the thickness (or height) of the downstream portion 60 need only be in the range of approximately 0.1–0.3 inches (2.5–7.6 mm) to produce significant airflow alteration, and thus noise, reductions. This effect is greatly enhanced by forming the downstream portion 60 as a continuous disk, directly in the airflow path, thereby providing a relatively substantial airflow interaction surface area. Finally, some additional noise reduction is achieved by the acoustic barrier material 24 absorbing a portion of the sound waves, as well as through sound wave cancellation occurring within the housing 22.

It is recognized that not all of the air entering the muffler 20 will be directed to the downstream portion 60 of the acoustic barrier material 24. That is to say, due to its turbulent nature, portions of the airflow will project in a generally radial fashion through the core passage 54 into the acoustic barrier material 24 at the upstream portion 58. Once again, the acoustic barrier material 24 at the upstream portion 58 serves as an airflow barrier, altering airflow characteristics. Because the acoustic barrier material 24 at the upstream portion 58 is relatively thin (radially), airflow will likely pass through the acoustic barrier material 24 to the housing 22 without significant alteration. Due to the frusto-conical shape of the housing 22, however, this airflow is subsequently directed downstream, where it encounters additional acoustic barrier material 24 surface area. Further, the frusto-conical shape naturally limits the formation of turbulent flow and related eddies. Thus, the preferred frusto-conical shape of the housing 22 facilitates a alteration in airflow and thus a reduction in noise. To minimize back pressure, a portion of the airflow is allowed to exhaust through the apertures 40.

The muffler 20 of the present invention provides significant noise attenuation. For example, with a pneumatic valve having an open exhaust port noise level in the range of approximately 50–100 dB, the muffler 20 will reduce pneumatic valve exhaust port noise by at least 10 dB; more preferably by at least 15 dB; most preferably by at least 20 dB. Importantly, the muffler 20 provides this noise attenuation while minimizing back pressure. The preferred composition of the acoustic barrier material 24 and shape of the housing 22 rapidly alters airflow and then allows airflow release at the outlet 32 and the apertures 42. For example, at airflow rates in the range of 5–30 cfm (141–848 liters/minute), the muffler 20 produces a back pressure in the range of approximately 5–60 psi (34–413 kPa).

The pneumatic muffler of the present invention provides a marked improvement over previous designs. The muffler is capable of being uniquely sized for use with a pneumatic valve having limited muffler clearance space. Unlike generally available pneumatic mufflers having diameters in excess of 3 inches (75 mm) and lengths in excess of 5 inches (127 mm), the muffler of the present invention is specifically designed so that it is capable of having both a maximum width and extension length less than approximately 1.5 inches (38 mm). With this greatly reduced size, the muffler can be used with valve banks having highly limited center-to-center exhaust port clearance. Further, the muffler of the present invention minimizes the opportunity for inadvertent operator contact and subsequent damage. Finally, unlike the few other reduced-sized mufflers currently available, the muffler of the present invention can provide significant noise attenuation with minimal back pressure.

EXAMPLES

The invention has been described with reference to various specific and preferred embodiments and will be further described by reference to the following detailed examples. It is understood, however, that there are many extensions, variations and modifications on the basic themes of the present invention beyond that shown in the examples and detailed description, which are in the spirit and scope of the present invention.

A muffler was prepared in accordance with a preferred embodiment of the present invention, having a polyamide (nylon 6, 6 reinforced with 33% by weight glass) housing with an exterior length of 1.2 inches (30.5 mm) and maximum diameter of 1 inch (25 mm) and 1.0 gram of a 2:1 parts by weight powdered epoxy resin: glass microbubbles ceramic acoustical barrier material with a core passage 0.36 inch (9.1 mm) in diameter and 0.9 inch (22.9 mm) in length. As a point of reference, the muffler did not include a cover (such as the cover 26 shown in FIG. 1). The muffler was secured to an exhaust port of a pneumatic valve device. The pneumatic valve was then operated and various data measured. In particular, a Brüel & Kjaer Type 2144 Real Time Dual Channel frequency analyzer microphone was placed 24 inches (61 cm) and at a 45 degree angle from the muffler. Sound was measured as an impulse in a one second window. Additionally, the cylinder recovery time of the pneumatic valve was measured. Cylinder recovery time is a measure of the time required for the cylinder associated with the pneumatic valve device to complete a single stroke. Effectively, cylinder recovery time is a function of back pressure in the system (e.g., an increase in back pressure causes an increase in cylinder recovery time). Thus, for example, where a muffler is connected to a pneumatic valve device, any back pressure caused by the muffler will increase cylinder recovery time.

With the above parameters in mind, measurements were taken during operation of the pneumatic valve both with and without a muffler. The following results were obtained:

Pneumatic Valve Performance Without Muffler

| Sample | Sound Pressure Level | Cylinder Recovery Time |
|---|---|---|
| 1 | 94.0 dB | 0.33 seconds |
| 2 | 94.5 dB | 0.336 seconds |
| 3 | 93.5 dB | 0.336 seconds |
| 4 | 95 dB | 0.337 seconds |
| Average | 94.5 dB | 0.337 seconds |

Pneumatic Valve Performance With Muffler

| Sample | Sound Pressure Level | Cylinder Recovery Time |
|---|---|---|
| 1 | 76 dB | 0.363 seconds |
| 2 | 75 dB | 0.360 seconds |
| 3 | 75 dB | 0.360 seconds |
| 4 | 76 dB | 0.359 seconds |
| Average | 75.5 dB | 0.360 seconds |

Although the present invention has been described with reference to preferred embodiments, workers skilled in the art will recognize that changes may be made in form and detail without departing from the spirit and scope of the present invention. For example, while the muffler has been described as incorporating a frusto-conical housing, other configurations may be useful. For example, the housing may be a cylinder. Alternatively, the housing may have multiple changes in diameter. Additionally, while the acoustic barrier material has been depicted as being formed contiguous with the housing outlet, other relationships may be employed. Thus, the acoustic barrier material may extend beyond the outlet, or may instead terminate upstream of the outlet. Similarly, the leading end of the acoustic barrier material may be positioned contiguous with the inlet, or may be spaced therefrom.

What is claimed is:

1. A muffler for attenuating noise produced at an exhaust port of a pneumatic device, the muffler comprising:

a housing including an inlet and an outlet, the inlet configured for mounting to the exhaust port, wherein at least a portion of the housing is frusto-conical such that the outlet has a diameter greater than a diameter of the inlet; and an acoustic barrier material disposed within the housing, the acoustic barrier material including a plurality of microbubbles and being configured to conform to a shape of the housing.

2. The muffler of claim 1, wherein the housing defines an extension length upon assembly to an exhaust port, the extension length being less than 38 mm.

3. The muffler of claim 1, wherein the outlet of the housing is open, the muffler further comprising:

a cover configured for placement over the outlet, the cover forming at least one opening.

4. The muffler of claim 1, wherein the housing is defined by a side wall having a plurality of apertures for allowing airflow from an interior of the housing.

5. The muffler of claim 4, wherein the plurality of apertures includes a plurality of circumferentially extending slots.

6. The muffler of claim 1, wherein the outlet defines a width that is less than approximately 38 mm.

7. The muffler of claim 6, wherein the outlet width is less than approximately 25 mm.

8. The muffler of claim 1, wherein the acoustic barrier material is a ceramic.

9. The muffler of claim 1, wherein the acoustic barrier material forms multiple tortuous passageways for reducing airflow velocity.

10. The muffler of claim 1, wherein the housing includes a plurality of apertures, and further wherein portions of the acoustic barrier material extend into the plurality of apertures to secure the acoustic barrier material to the housing.

11. The muffler of claim 1, wherein the acoustic barrier material is configured to form a core passage in fluid communication with the inlet and extending axially toward the outlet to a closed end, the core passage being closed at the outlet.

12. The muffler of claim 11, wherein the housing includes a side wall forming a plurality of apertures, and further wherein the closed end is downstream of the plurality of apertures.

13. The muffler of claim 11, wherein the acoustic barrier material is defined by an upstream portion forming the core passage and a downstream portion defining the closed end and extending to the outlet, the downstream portion having a thickness in the range of approximately 2.5–7.6 mm.

14. The muffler of claim 13, wherein the downstream portion is continuous across a diameter of the housing.

15. The muffler of claim 13, wherein the core passage is configured to direct airflow from the inlet to the downstream portion.

16. The muffler of claim 1, wherein the muffler is configured to reduce noise entering the inlet by at least 10 dB as compared to an open exhaust port state.

17. A pneumatic valve device comprising:

a pneumatic valve forming an exhaust port; and a muffler in accordance with claim 1 fluidly connected to the exhaust port.

18. The pneumatic valve device of claim 17, wherein the housing defines an extension length following assembly to an exhaust port, the extension length being less than 38 mm.

19. The pneumatic valve device of claim 17, wherein the housing is defined by a side wall having a plurality of apertures for allowing airflow from an interior of the housing.

20. The pneumatic valve device of claim 17, wherein the outlet defines a width that is less than approximately 38 mm.

21. The pneumatic valve device of claim 17, wherein the housing includes a plurality of apertures, and further wherein portions of the acoustic barrier material extend into the plurality of apertures to secure the acoustic barrier material to the housing.

22. The pneumatic valve device of claim 17, wherein the acoustic barrier material is configured to form a core passage in fluid communication with the inlet and extending axially toward the outlet to a closed end, the core passage being closed at the outlet.

23. A muffler for attenuating noise produced at an exhaust port of a pneumatic device, the muffler comprising:

a housing including an inlet and an outlet, the inlet configured for mounting to the exhaust port, wherein the housing defines a maximum width of less than approximately 38 mm; and an acoustic barrier material disposed within the housing, the acoustic barrier material including a plurality of microbubbles and being configured to conform to a shape of the housing.

24. The muffler of claim 23, wherein at least a portion of the housing is frusto-conical such that the maximum width is proximal the outlet.

25. The muffler of claim 23, wherein the maximum width of the housing is less than approximately 25 mm.

26. The muffler of claim 23, wherein the housing defines an extension length upon assembly to an exhaust port, the extension length being less than approximately 38 mm.

27. The muffler of claim 23, wherein the acoustic barrier material comprises microbubbles bound together at their contact points.

28. The muffler of claim 23, wherein the acoustic barrier material is configured to form a core passage in fluid communication with the inlet and extending toward the outlet, the core passage being closed at the outlet.

29. The muffler of claim 28, wherein the housing includes a side wall forming a plurality of apertures, and further wherein the core passage extends beyond the plurality of apertures.

30. The muffler of claim 29, wherein the acoustic barrier material is defined by an upstream portion forming the core passage, and a downstream portion defining a closed end of the core passage and extending to the outlet, the downstream portion having a thickness in the range of approximately 2.5–7.6 mm.

31. The muffler of claim 29, wherein the core passage is configured to direct airflow in an axial fashion from the inlet to the downstream portion, and further wherein the downstream portion forms a radial barrier to the axial flow.

32. A pneumatic valve device comprising:

a pneumatic valve forming an exhaust port; and a muffler in accordance with claim 23 fluidly connected to the exhaust port.

33. The pneumatic valve device of claim 32, wherein at least a portion of the housing is frusto-conical such that the maximum width is proximal the outlet.

34. The pneumatic valve device of claim 32, wherein the housing defines an extension length upon assembly to an exhaust port, the extension length being less than approximately 38 mm.

35. The pneumatic valve of claim 32, wherein the acoustic barrier material is configured to form a core passage in fluid communication with the inlet and extending toward the outlet, the core passage being closed at the outlet.

36. A method of manufacturing a muffler for attenuating noise produced at an exhaust port of a pneumatic device, the method including:

providing a housing including an inlet and an outlet;

providing an acoustic barrier material that is flowable in a first state and relatively rigid in a second state;

inserting the acoustic barrier material in the first state into the housing such that the acoustic barrier material conforms with a shape of the housing; and transitioning the acoustic barrier material to the second state.

37. The method of claim 36, wherein the housing includes a side wall forming a plurality of apertures, and further wherein inserting the acoustic barrier material includes forcing a portion of the acoustic barrier material into at least one of the plurality of apertures to secure the acoustic barrier material to the housing.

38. The method of claim 36, further including:

forming a core passage in the acoustic barrier material, the core passage being in fluid communication with the inlet and extending in an axial fashion through a portion of the acoustic barrier material.

* * * * *